US009121268B2

(12) United States Patent
Minnock

(10) Patent No.: US 9,121,268 B2
(45) Date of Patent: Sep. 1, 2015

(54) INLINE RETRIEVABLE SYSTEM

(71) Applicant: Cameron International Corporation, Houston, TX (US)

(72) Inventor: Kevin Minnock, Longford (IE)

(73) Assignee: Cameron International Corporation, Houston, TX (US)

( * ) Notice: Subject to any disclaimer, the term of this patent is extended or adjusted under 35 U.S.C. 154(b) by 0 days.

(21) Appl. No.: 14/145,096

(22) Filed: Dec. 31, 2013

(65) Prior Publication Data

US 2015/0184496 A1 Jul. 2, 2015

(51) Int. Cl.

| | |
|---|---|
| ***E21B 34/04*** | (2006.01) |
| ***E21B 43/12*** | (2006.01) |
| ***E21B 17/02*** | (2006.01) |
| ***E21B 44/00*** | (2006.01) |
| ***E21B 33/076*** | (2006.01) |

(52) U.S. Cl.

CPC ..... *E21B 43/12* (2013.01); *E21B 17/028* (2013.01); *E21B 33/076* (2013.01); *E21B 34/045* (2013.01); *E21B 44/005* (2013.01)

(58) Field of Classification Search

CPC ..... E21B 43/12; E21B 44/005; E21B 17/028; E21B 34/045; E21B 33/076

USPC ..... 166/340, 343, 344, 365, 351; 285/11, 285/77, 121.2, 145.1, 302; 137/219, 315.02

See application file for complete search history.

(56) References Cited

U.S. PATENT DOCUMENTS

| | | | | |
|---|---|---|---|---|
| 3,649,949 | A * | 3/1972 | McCarthy et al. | 439/194 |
| 2010/0126600 | A1* | 5/2010 | Watson | 137/486 |
| 2012/0170410 | A1* | 7/2012 | Hay | 367/82 |
| 2012/0325488 | A1* | 12/2012 | Grace et al. | 166/351 |
| 2013/0008669 | A1* | 1/2013 | Deere et al. | 166/378 |

* cited by examiner

*Primary Examiner* — James G Sayre
(74) *Attorney, Agent, or Firm* — Fletcher Yoder, P.C.

(57) ABSTRACT

A system including an inline retrievable module, including a conduit configured to removably mount inline within a passage of a hydrocarbon extraction system, a first coupler having a first range of axial movement at a first end portion of the conduit, a second coupler having a second range of axial movement at a second end portion of the conduit, and an actuation system configured to actuate the first and second couplers to move along the respective first and second axial ranges of movement between coupled positions and uncoupled positions relative to the conduit.

20 Claims, 7 Drawing Sheets

INLINE RETRIEVABLE SYSTEM

BACKGROUND

This section is intended to introduce the reader to various aspects of art that may be related to various aspects of the present invention, which are described and/or claimed below. This discussion is believed to be helpful in providing the reader with background information to facilitate a better understanding of the various aspects of the present invention. Accordingly, it should be understood that these statements are to be read in this light, and not as admissions of prior art.

Wells are often used to access resources below the surface of the earth. For instance, oil, natural gas, and water are often extracted via a well. Some wells are used to inject materials below the surface of the earth, e.g., to sequester carbon dioxide, to store natural gas for later use, or to inject steam or other substances near an oil well to enhance recovery. Due to the value of these subsurface resources, wells are often drilled at great expense, and great care is typically taken to extend their useful life.

Chemical-injection management systems are often used to maintain a well and/or enhance well output. For example, chemical-injection management systems may inject chemicals to extend the life of a well or increase the rate at which resources are extracted from a well. Typically, these materials are injected into the well in a controlled manner over a period of time by the chemical-injection management system.

BRIEF DESCRIPTION OF THE DRAWINGS

Various features, aspects, and advantages of the present invention will become better understood when the following detailed description is read with reference to the accompanying figures in which like characters represent like parts throughout the figures, wherein.

DETAILED DESCRIPTION OF SPECIFIC EMBODIMENTS

One or more specific embodiments of the present invention will be described below. These described embodiments are only exemplary of the present invention. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

The present disclosure is generally directed toward an inline retrievable system. The inline retrievable system is capable of insertion and removal from a sub-sea resource (e.g., hydrocarbon) extraction system with a remotely operated vehicle (ROV), which facilitates and reduces costs for repairing, inspecting, or replacing fluid injection systems, flow meters, sensors, non-return valves, shut-off valves, throttling valves, or a combination thereof. Moreover, the inline retrievable system attaches with a low lockdown force. Indeed, the inline retrievable system will experience limited or no blowout load because seals on the couplers of the inline retrievable system are pressure balanced.

The inline retrievable system may couple to the subsea resource (e.g., hydrocarbon) extraction system with a hydraulic actuation system or a mechanical actuation system. The hydraulic and mechanical actuation systems may be redundantly activated with input from a controller within the inline retrievable system or with a remotely operated vehicle (ROV). The redundant activation increases the inline retrievable system's reliability in coupling and decoupling from the subsea resource (e.g., hydrocarbon) extraction system, and reduces costs for repairing the inline retrievable system. In operation, the inline retrievable system enables fluid property measurement and/or fluid control in resource (e.g., hydrocarbon) extraction operations. For example, the fluid injection system may enable fluid measurement and control to increase resource extraction or to increase the operating life of a well.

Figure 1:
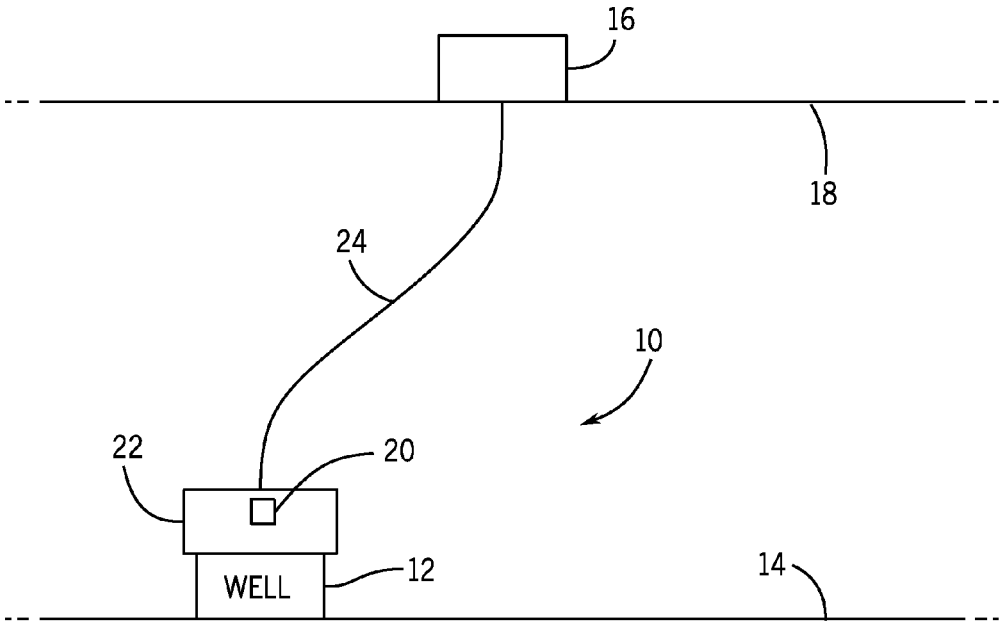
FIG. 1 is a block diagram of an embodiment of an exemplary sub-sea resource extraction system within an inline retrievable system.

FIG. 1 depicts an exemplary sub-sea resource extraction system 10. In particular, the sub-sea resource extraction system 10 may be used to extract oil, natural gas, and other related resources from a well 12, located on a sub-sea floor 14, to an extraction point 16 at a surface location 18. The extraction point 16 may be an on-shore processing facility, an offshore rig, or any other extraction point. The sub-sea resource extraction system 10 may also be used to inject fluids, such as water, gas, chemicals, and so forth, into the well 12. As the fluids flow into the well 12 the fluids may be metered by a flow meter, flow through a non-return valve, and/or be monitored by one or more sensors. These devices (e.g., a non-return valve, flow meter, and/or sensors) may couple to an inline retrievable system 20 for use in a Christmas tree 22 or at another location on the sub-sea resource extraction system 10. As illustrated, the Christmas tree 22 fluidly couples to the extraction point 16 with flexible jumper or umbilical lines 24 that enable the sub-sea equipment to receive the working fluids.

Figure 2:
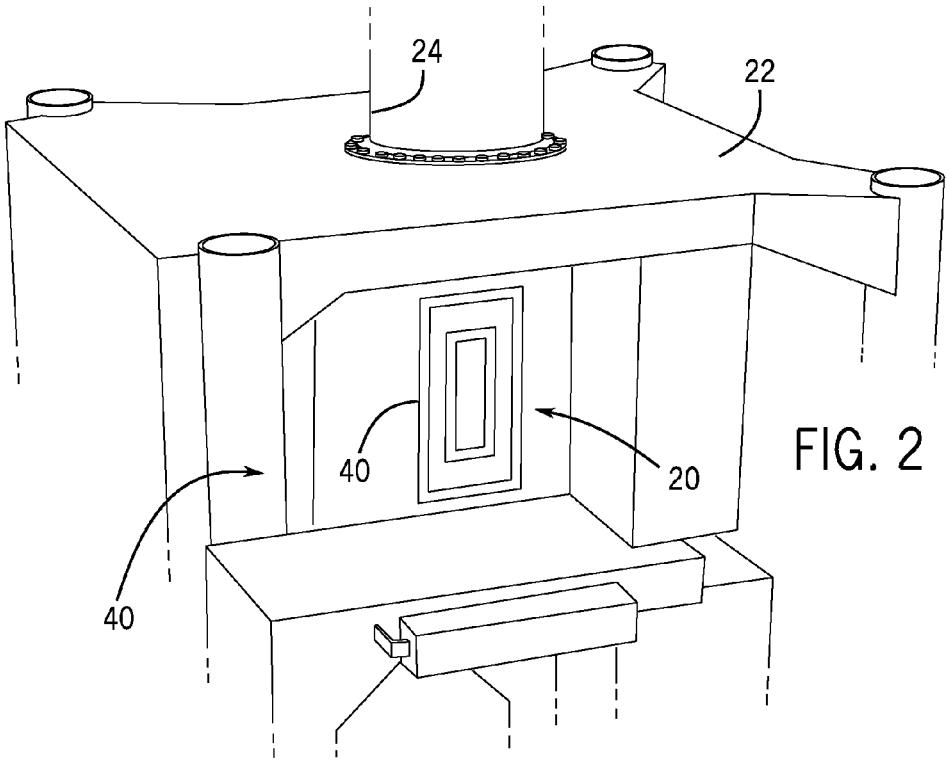
FIG. 2 is a partial perspective view of an embodiment of a Christmas tree with an inline retrievable system.

FIG. 2 is a partial perspective view of an embodiment of the Christmas tree 22 with the inline retrievable system 20 (e.g., modular unit with an insertable/in-line portion and an external portion). The tree 22 couples to the well 12 and may include a variety of valves, fittings, and controls for extracting resources out of the well 12. As illustrated, the Christmas tree 22 includes the receptacle 40 that receives the inline retrievable system 20. The receptacle 40 may enable fluid and electrical communication between the Christmas tree 22 and the inline retrievable system 20. As will be explained in further detail below, the inline retrievable system 20 facilitates attachment and removal of sensors, flow meters, and non-return valves among other devices. For example, the inline retrievable system 20 may include a flow meter that injects water, gas, corrosion-inhibiting materials, foam-inhibiting materials, wax-inhibiting materials, antifreeze, and/or various chemicals to extend the life of a well or increase a resource (e.g., hydrocarbon) extraction rate out of the well. Moreover, the inline retrievable system 20 simplifies construction of the subsea resource extraction system 10 by reducing the number of bends and turns that route fluid through the inline retrievable system 20.

Figure 3:
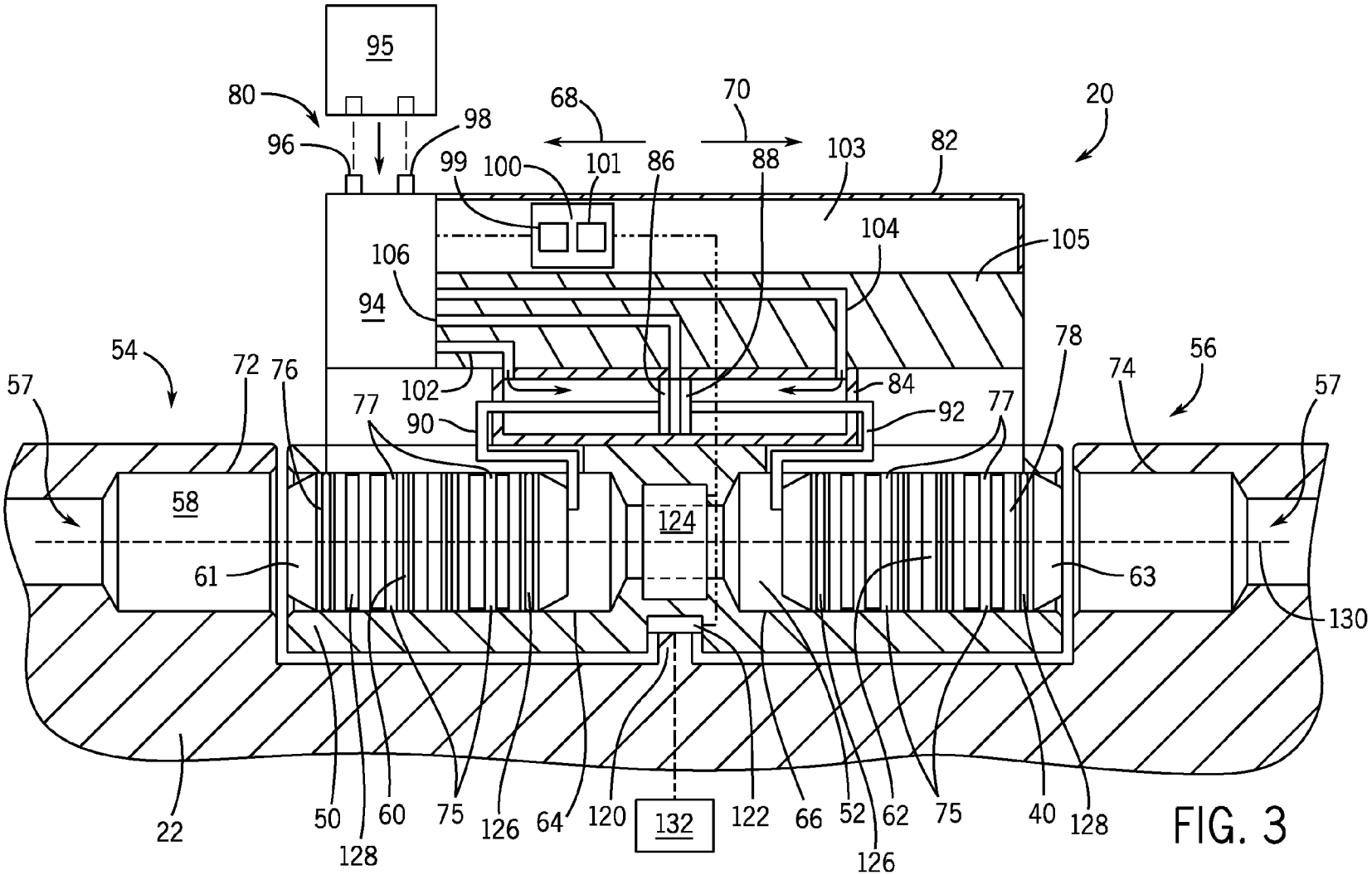
FIG. 3 is a partial cross-sectional view of an embodiment of an inline retrievable system with a hydraulic actuation system in an uncoupled position.

FIG. 3 is a partial cross-sectional view of an embodiment of an inline retrievable system 20 in a mechanically uncoupled position. As illustrated, the inline retrievable system 20 includes a conduit 50 (i.e., an insertable/in-line portion) with a passage or aperture 52. The conduit 50 rests within the receptacle 40 between the first and second openings 54 and 56 of a passage 57. As illustrated, the receptacle 40 is generally perpendicular to the first and second openings 54 and 56 of the passage 57, enabling alignment of the conduit 50 with the first and second openings 54 and 56 of the passage 57. As illustrated, the conduit 50 enables fluid communication between the first and second openings 54 and 56 of the passage 57. Indeed, together the conduit aperture 52 and the first and second openings 54 and 56 form a fluid flow path 58 that enables fluid to flow through the inline retrievable system 20 and the passage 57 without bending or turning the fluid. The conduit 50 couples within the receptacle 40 with first and second axially movable couplers 60 and 62 that form fluid tight seals between the inline retrievable system 20 and the passage 57 of the Christmas tree 22.

The couplers 60 and 62 rest within respective counter bores 64 and 66 of the conduit 50. In operation, the couplers 60 and 62 move in opposite axial directions 68 and 70 to mechanically couple and decouple the inline retrievable system 20 from the passage 57 of the Christmas tree 22. Specifically, as the couplers 60 and 62 move in axial directions 68 and 70, the couplers 60 and 62 engage and disengage the respective counterbores 72 and 74 in the openings 54 and 56 of the passage 57, to couple and decouple the conduit 50. The couplers 60 and 62 may be cylindrical in shape with a hollow center (e.g., central passage 61, 63) that enables fluid to flow from the passage 57 of the Christmas tree 22 through the conduit 50 and back into the passage 57 of the Christmas tree 22. The couplers 60 and 62 may include multiple grooves 75 on respective exterior surfaces 76 and 78 that may receive annular gaskets 77 (e.g., metal seals, elastomeric seals, etc). The annular gaskets 77 form a fluid tight seal between the passage 57 of the Christmas tree 22 and the couplers 60 and 62; and between the conduit 50 and the couplers 60 and 62.

The couplers 60 and 62 axially move in response to an actuation system 80 that rests within a housing 82 (i.e., external portion of the inline retrievable system 20) coupled to the conduit 50 (i.e., insertable/inline portion of the inline retrievable system 20). In some embodiments, the actuation system 80 may be a hydraulic actuation system. The actuation system 80 includes a hydraulic cylinder 84 with pistons 86 and 88 that move in axial directions 68 and 70. As illustrated, the arms 90 and 92 couple to respective pistons 86 and 88; and to the respective couplers 60 and 62. Accordingly, as the pistons 86 and 88 move in axial directions 68 and 70, the couplers 60 and 62 also move in the axial directions 68 and 70. In operation, the pistons 86 and 88 axially move in response to changing hydraulic pressure in the hydraulic cylinder 84. The actuation system 80 may change the pressure in the hydraulic cylinder 84 with an internal hydraulic pump 94 (i.e., a primary hydraulic source) or through an external hydraulic fluid source 95 (i.e., a secondary hydraulic source), which pumps and removes hydraulic fluid through the external hydraulic fluid connections 96 and 98. For example, a controller 100 in the housing 50 may signal the pump 94 and/or source 95 to begin pumping fluid through hydraulic fluid lines 102 and 104. The controller 100 may be an electronic control unit having a processor 99 and memory 101, thereby enabling the controller 100 to store and execute instructions to operate the actuation system 80, obtain feedback from sensors (e.g., block 124), a flow meter (e.g., block 124), and/or control a valve (e.g., block 124). As the hydraulic fluid flows through the hydraulic lines 102 and 104, the hydraulic fluid forces the pistons 86 and 88 to move axially toward one another. As the pistons 86 and 88 move axially towards one another, the arms 90 and 92 axially retract the couplers 60 and 62 into the housing 50 of the inline retrievable system 20 and out of the openings 54 and 56 of the passage 57. In some embodiments, an external hydraulic fluid source (e.g., ROV) may pump hydraulic fluid through the hydraulic connection 96 to the hydraulic cylinder 84 through the hydraulic lines 102 and 104, thereby hydraulically moving the pistons 86 and 88 and retracting the couplers 60 and 62 into the system 20. To protect the controller 100, the housing 82 includes a wall 105 that forms a sealed portion 103 of the housing 82 that receives the controller 100.

Figure 4:
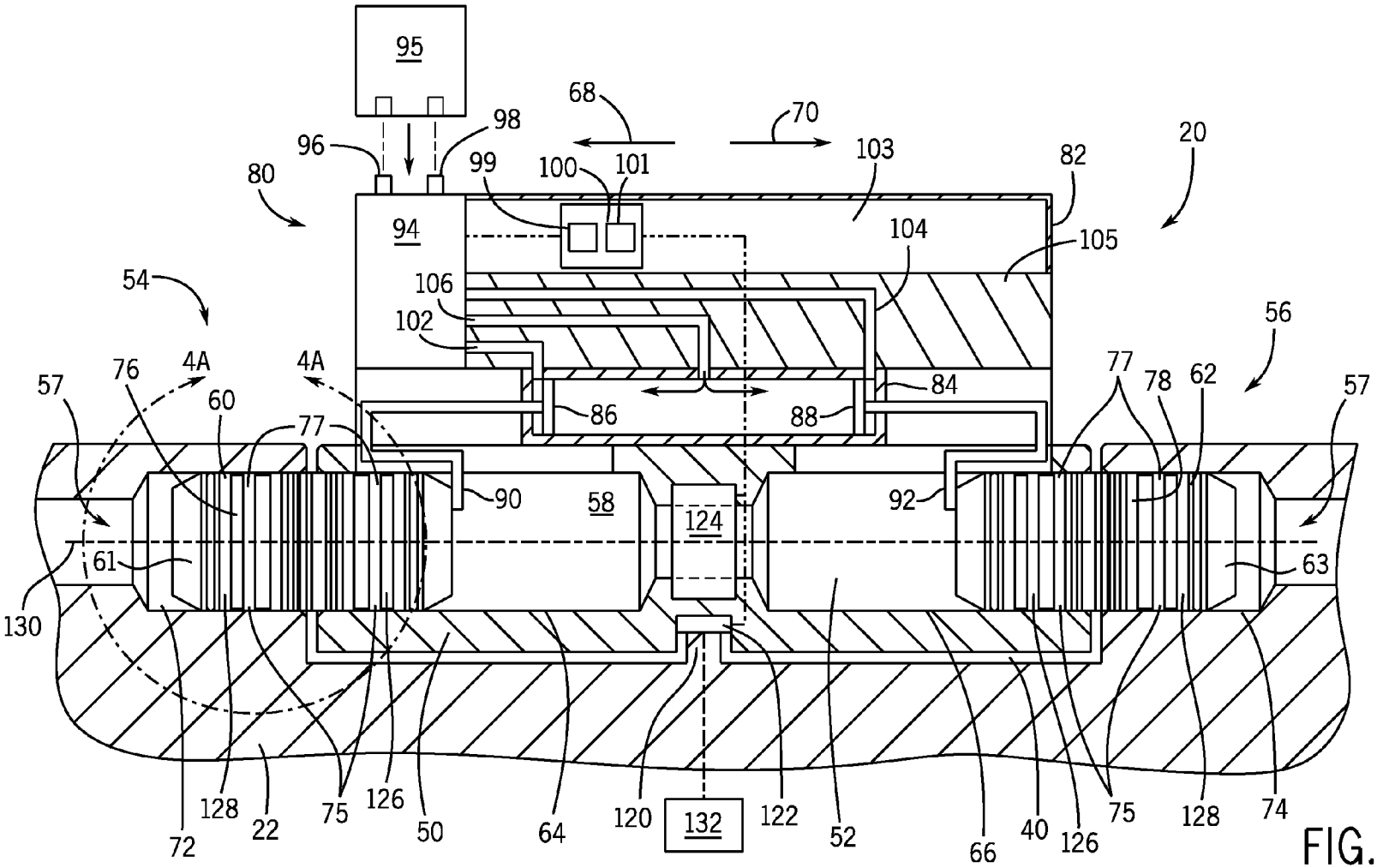
FIG. 4 is a partial cross-sectional view of an embodiment of an inline retrievable system with a hydraulic actuation system in a coupled position.

FIG. 4 is a partial cross-sectional view of an embodiment of an inline retrievable system 20 in a coupled position, with the coupler 60 in the counterbore 72 and the coupler 62 in the counterbore 74 of the passage 57. In this position, the inline retrievable system 20 forms the fluid flow path 58 between the first and second openings 54 and 56 of the passage 57, enabling fluid flow through the fluid conduit 50 and the passage 57. As illustrated, the inline retrievable system 20 forms the fluid flow path 58 without bends (e.g., in-line with the passage 57). Moreover, the inline retrievable system 20 attaches with a low lockdown force. Indeed, the inline retrievable system 20 will experience limited or no blowout load because the seals 77 are pressure balanced across the couplers 60, 62. More specifically, the seals 77 on the first portion 126 of the couplers 60, 62 have the same diameter as the seals 77 on the second portion 128 of the couplers 60, 62. The equal diameter of the seals 77 blocks unequal pressure distribution on the seals 77. In other words, a pressurized fluid flowing through the inline retrievable system 20 will apply a force on the seals 77 on the first portion 126 that cancels the force of the pressurized fluid acting on the seals 77 on the second portion 128 of the couplers 60, 62.

As explained above, the actuation system 80 axially moves the couplers 60 and 62 between extended positions (FIG. 4) and retracted positions (FIG. 3) by pumping hydraulic fluid into the hydraulic cylinder 84. In operation, the controller 100 signals the fluid pump 94 (e.g., primary hydraulic source) to pump fluid through the hydraulic line 106 to axially move the couplers 60 and 62 from the retracted positions (FIG. 3) to the extended positions (e.g., coupled positions of FIG. 4). As illustrated, the hydraulic line 106 enables hydraulic fluid to enter between the pistons 86 and 88, forcing the pistons 86 and 88 to move axially away from one another in the directions 68 and 70. The axial movement of the pistons 86 and 88 moves the arms 90 and 92 in the respective axial directions 68 and 70, which moves the couplers 60 and 62 into engagement with the respective first and second openings 54 and 56 of the passage 57 (i.e., into counterbores 76 and 78). In some embodiments, an external or secondary hydraulic fluid source 95 (e.g., a tool or ROV) may pump hydraulic fluid through the connection 98 enabling hydraulic fluid to flow through the hydraulic line 106, which moves the pistons 86 and 88 axially away from each other extending the couplers 60 and 62 into a coupled position (FIG. 4). Accordingly, the inline retrievable system 20 may enable redundant or provide backup actuation of the couplers 60 and 62.

In the coupled position (FIG. 4), the inline retrievable system 20 is mechanically coupled and may be electrically coupled to the Christmas tree 22 or another structure. As illustrated, the Christmas tree 22 may include an electrical connector 120 that couples to a corresponding electrical connector 122 on the conduit 50. The electrical connection (120, 122) may enable an external controller 132 to communicate with and control the controller 100 (e.g., cross control with Christmas tree 22 or other controller), a flow meter (i.e., block 124), sensors (i.e., block 124), valves (i.e., block 124) or a combination thereof. In operation, the flow meter may accurately inject water, gas, steam, chemicals, corrosion-inhibiting materials, foam-inhibiting materials, wax-inhibiting materials, and/or antifreeze to extend the life of a well or increase the resource extraction rate from the well 12. In some embodiments, the inline retrievable system 20 may include one or more sensors that measure a property of a flow moving through the Christmas tree (e.g., fluid speed, density, material composition, temperature, pressure, corrosiveness, etc.).

Figure 4A:
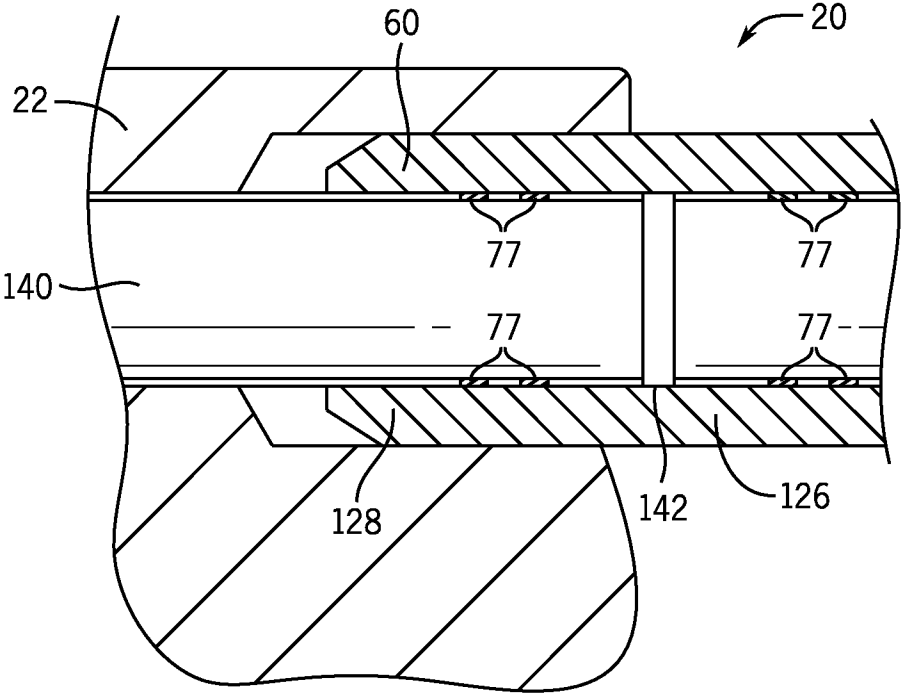
FIG. 4A is a partial sectional view of an embodiment of the inline retrievable system of FIG. 4 along line 4A-4A.

FIG. 4A is a partial sectional view of another embodiment of the inline retrievable system 20 of FIG. 4 along line 4A-4A. In FIG. 4A the coupler 60 of the inline retrievable system 20 couples to a conduit 140 that extends from the Christmas tree 22. Accordingly, the inline retrievable system 20 may couple to the Christmas tree 22 by driving couplers 60, 62 over conduits (e.g., conduit 140); instead, of moving couplers 60, 62 into counterbores 72, 74 (seen in FIG. 4). The couplers 60, 62 form a seal with the conduit 140 by including seals 77 along an interior surface 142 of the conduits 60, 62. By coupling to a conduit 140, the couplers 60, 62 may enable a constant flow cross-section through the inline retrievable system 20.

Figure 5:
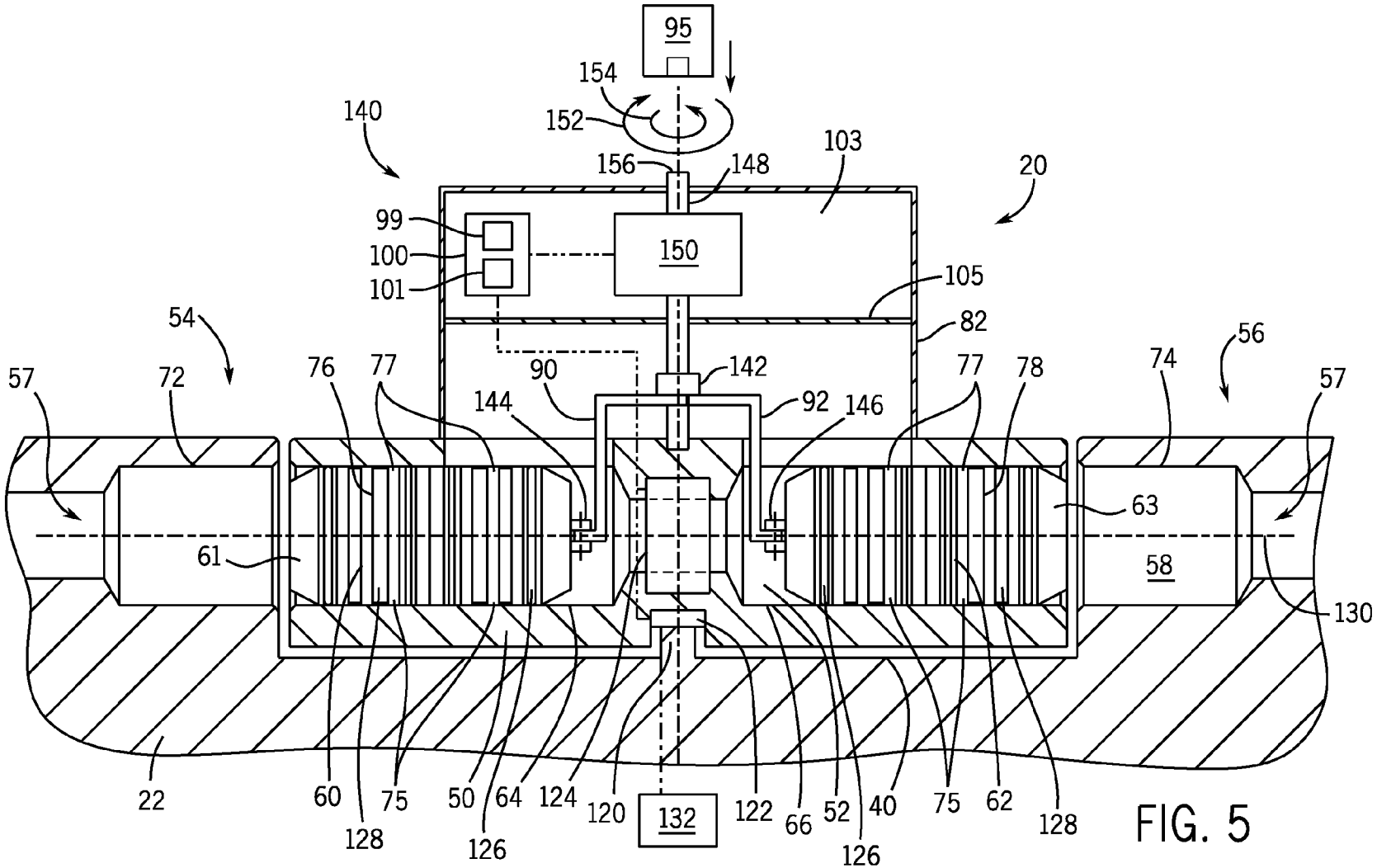
FIG. 5 is a partial cross-sectional view of an embodiment of an inline retrievable system with a mechanical actuation system in an uncoupled position.

FIG. 5 is a partial cross-sectional view of an embodiment of an inline retrievable system 20 with the couplers 60 and 62 in a retracted (i.e., uncoupled) position. As explained above, the inline retrievable system 20 may include an actuation system 140, such as a mechanical actuation system. The mechanical actuation system 140 includes a rotatable cam 142 that couples to the arms 90 and 92 that then couple to the couplers 60 and 62 with hinged connections 144 and 146. In operation, rotation of the cam 142 moves the arms 90 and 92, which axially move the couplers 60 and 62 between the retracted and extended positions (i.e., the coupled and uncoupled positions). More specifically, the cam 142 couples to a shaft 148 that is rotatable by a motor 150 or by an external drive or tool (e.g., a remotely operated vehicle or ROV). When the shaft 148 rotates in clockwise direction 152 or in a counter-clockwise direction 154, the shaft rotates the cam 142, which moves the arms 90 and 92 coupled to the couplers 60 and 62. As the couplers 60 and 62 axially extend and axially retract, the inline retrievable system 20 couples and uncouples from the passage 57 of the Christmas tree 22.

Figure 6:
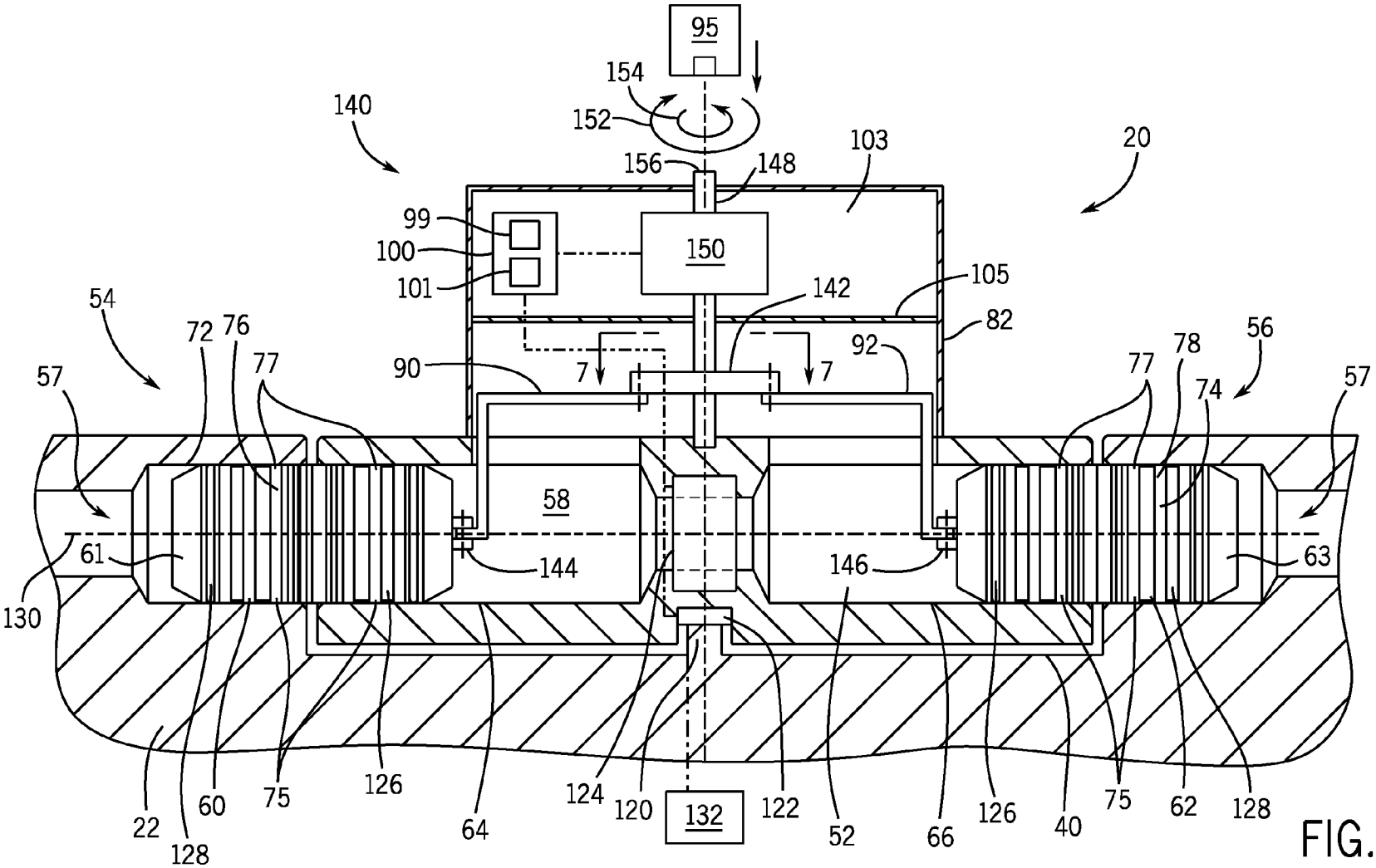
FIG. 6 is a partial cross-sectional view of an embodiment of an inline retrievable system with a mechanical actuation system in a coupled position.

FIG. 6 is a partial cross-sectional view of an embodiment of an inline retrievable system 20 in a coupled position, with the coupler 60 in the counterbore 72 and the coupler 62 in the counterbore 74 of the passage 57. As explained above, in the coupled position, the conduit 50 forms the fluid flow path 58 between the first and second openings 54 and 56 of the passage 57, which enables fluid to flow through the fluid conduit 50 and the passage 57. As illustrated, the inline retrievable system 20 forms the fluid flow path 58 without bends (e.g., inline with passage 57). As explained above, the inline retrievable system 20 attaches with a low lockdown force because the seals 77 are pressure balanced across the couplers 60, 62. More specifically, the seals 77 on the first portion 126 of the couplers 60, 62 have the same diameter as the seals 77 on the second portion 128 of the couplers 60, 62. Accordingly, a pressurized fluid flowing through the inline retrievable system 20 will apply a force on the seals 77 on the first portion 126 that is equal and opposite to the force applied to the seals 77 on the second portion 128 of the couplers 60, 62.

As explained above, the mechanical actuation system 140 axially moves the couplers 60 and 62 between the extended positions (FIG. 6) and retracted positions (FIG. 5) by rotating the cam 142. In some embodiments, the controller 100 signals the motor 150 to rotate the shaft 148, which rotates the cam 142 and axially moves the couplers 60 and 62 in respective axial directions 68 and 70. In some embodiments, an external tool 95 (e.g., a remotely operated vehicle (ROV)) may rotate the shaft 148 by coupling to a portion 156 of the shaft 148. Accordingly, the inline retrievable system 20 may enable redundant or backup actuation of the couplers 60 and 62.

In the coupled position (FIG. 6), the inline retrievable system 20 is mechanically coupled and may be electrically coupled to the Christmas tree 22 or another structure. As explained above, the Christmas tree 22 or other structure may include an electrical connector 120 that couples to a corresponding electrical connector 122 on the conduit 50. The electrical connection (120, 122) may enable an external controller 132 (e.g., a controller on the Christmas tree 22 or at the extraction point 16) to communicate with the controller 100. For example, as explained above, the inline retrievable system 20 may include a sensor, a flow meter, and/or a non-return valve among other devices, as illustrated by block 124. In operation, the flow meter may help to accurately inject water, gas, corrosion-inhibiting materials, foam-inhibiting materials, wax-inhibiting materials, chemicals, and/or antifreeze to extend the life of a well or increase the resource extraction rate from the well 12. In some embodiments, the inline retrievable system 20 may include a sensor that measures a property of the flow moving through the Christmas tree (e.g., fluid speed, density, corrosiveness, etc.). In some embodiments, the inline retrievable system 20 may also include a non-return valve, alone or in combination with a flow meter and/or a sensor. As explained above, the housing 82 includes a wall 105 that forms a sealed portion 103 of the housing 82 that receives and protects the controller 100 and motor 150.

Figure 7:
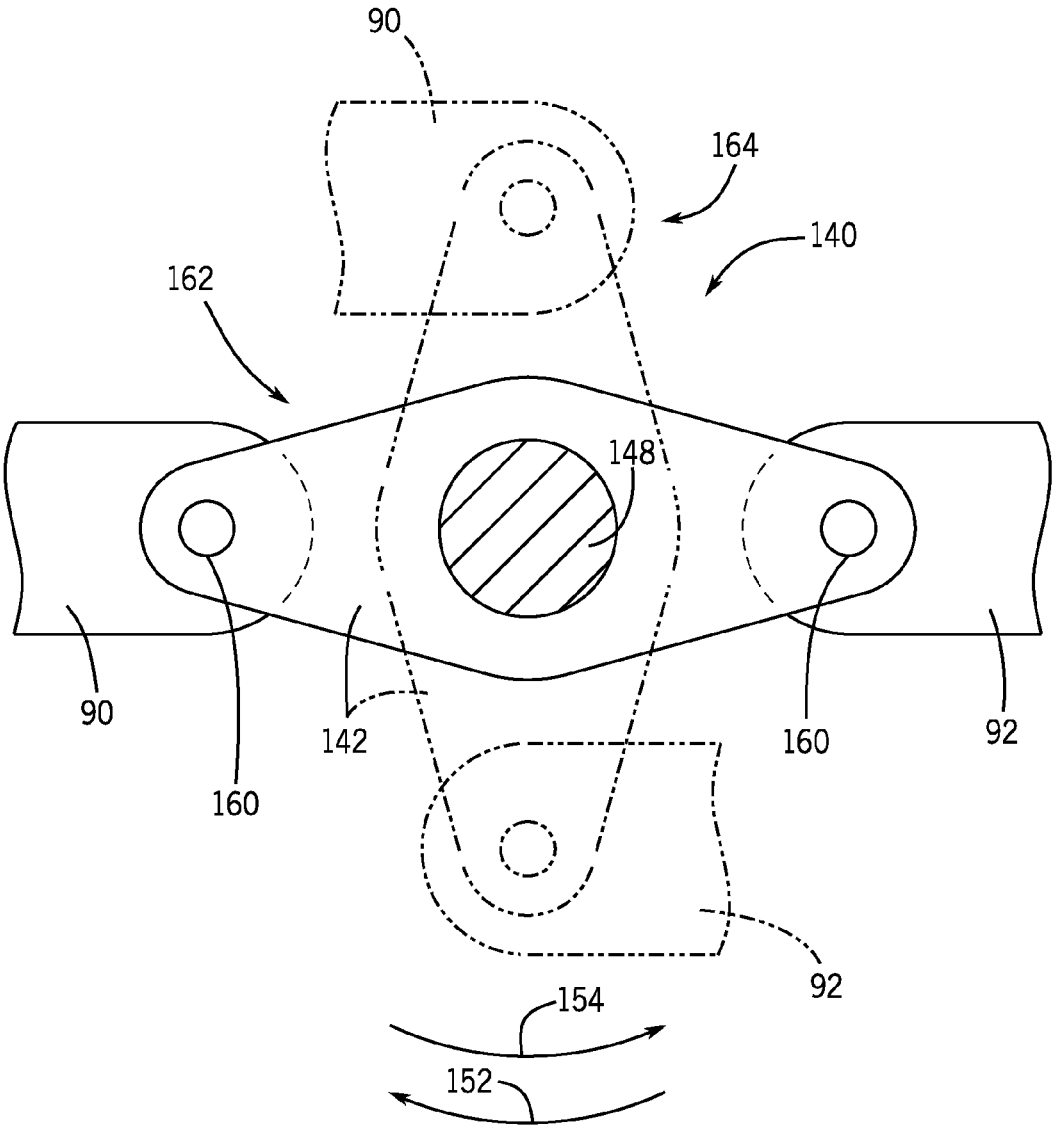
FIG. 7 is a partial cross-sectional view of an embodiment of the mechanical actuation system along line 7-7 of FIG. 6.

FIG. 7 is a partial cross-sectional view of an embodiment of the cam 142 coupled to the arms 90 and 92 of the mechanical activation system 140, of FIGS. 5 and 6. As illustrated, the arms 90 and 92 couple to the cam 142 with bolts or pins 160. Thus, as the shaft 148 rotates the cam 142, in response to the motor 150, the pins 160 maintain contact between the cam 142 and the arms 90 and 92. As illustrated, the cam 142 may rotate between a first position 162 (i.e., illustrated by the solid lines) and a second position 164 (i.e., illustrated by the dashed lines). In the first position 162, the arms 90 and 92 are in an extended position (e.g., axially aligned with axis of conduit 50), which forces the couplers 60 and 62 to move axially into an extended or coupled position (FIG. 6), wherein the inline retrievable system 20 couples to the Christmas tree 22. When the cam 142 rotates to the second position 164, in response to the motor 150, the arms 90 and 92 axially retract, moving the couplers 60 and 62 into a retracted or uncoupled position (FIG. 5), thus enabling retrieval of the inline retrievable system 20.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. A system, comprising:

an inline retrievable module, comprising:

a fluid conduit configured to removably mount inline within a fluid passage of a hydrocarbon extraction system;

a first coupler having a first range of axial movement at a first end portion of the fluid conduit;

a second coupler having a second range of axial movement at a second end portion of the fluid conduit; and an actuation system configured to actuate the first and second couplers to move along the respective first and second axial ranges of movement between coupled positions and uncoupled positions relative to the fluid conduit.

2. The system of claim 1, comprising a controller configured to control the actuation system.

3. The system of claim 1, wherein the fluid conduit comprises a first electrical connector configured to mate with a second electrical connector of the hydrocarbon extraction system.

4. The system of claim 1, wherein the in-line retrievable module comprises a housing coupled to the fluid conduit, wherein the housing encloses the actuation system and the controller.

5. The system of claim 1, wherein the actuation system comprises a hydraulic actuation system.

6. The system of claim 1, wherein the actuation system comprises a mechanical actuation system.

7. The system of claim 6, wherein the mechanical actuation system comprises an electric motor.

8. The system of claim 1, wherein the in-line retrievable module comprises a flow meter within the fluid conduit and inline with the fluid passage.

9. The system of claim 8, wherein the flow meter is an ultrasonic flow meter.

10. The system of claim 1, wherein the in-line retrievable module comprises a non-return valve within the fluid conduit and inline with the fluid passage.

11. The system of claim 1, wherein the in-line retrievable module comprises a sensor within the fluid conduit.

12. The system of claim 1, wherein the hydrocarbon extraction system comprises a Christmas tree.

13. A method, comprising:

inserting an inline retrievable module into a fluid flow path of a hydrocarbon extraction system, wherein the inline retrievable module comprises a first coupler at a first end of the inline retrievable module and a second coupler opposite the first coupler at a second end of the inline retrievable module; and engaging the first and second couplers with an actuation system that axially inserts the first and second couplers into the hydrocarbon extraction system and axially retracts the first and second couplers from the hydrocarbon extraction system.

14. The method of claim 13, comprising electrically connecting the inline retrievable system to the hydrocarbon extraction system.

15. The method of claim 13, comprising controlling fluid flow through the inline retrievable module with a flow meter.

16. A system, comprising:

an inline retrievable module, comprising:

a conduit configured to removably mount inline within a passage of a hydrocarbon extraction system through a lateral opening into the passage;

first and second couplers configured to couple opposite first and second end portions of the conduit to the hydrocarbon extraction system and enable fluid flow through the conduit;

an actuation system configured to actuate the first and second couplers to move the first and second couplers between coupled and uncoupled positions relative to the conduit; and a controller coupled to the activation system, wherein the controller is configured to control actuation of the actuation system to move the first and second couplers between the coupled and uncoupled positions.

17. The system of claim 16, wherein the inline retrievable system comprises a flow meter.

18. The system of claim 16, wherein the inline retrievable system comprises a sensor.

19. The system of claim 16, wherein the actuation system comprises a hydraulic actuation system.

20. The system of claim 16, wherein the actuation system comprises a mechanical actuation system.

* * * * *